United States Patent [19]

Bishop

[11] Patent Number: 4,718,597

[45] Date of Patent: Jan. 12, 1988

[54] BLANK AND A BOX THEREFROM HAVING EXTENDED LIFE

[75] Inventor: Richard E. Bishop, Weston, Canada

[73] Assignee: Domtar Inc., Montreal, Canada

[21] Appl. No.: 911,160

[22] Filed: Sep. 24, 1986

[51] Int. Cl.[4] ..... B65D 5/46

[52] U.S. Cl. ..... 229/52 B; 229/199

[58] Field of Search ..... 229/52 B, 52 BC, 199, 229/52 A, 48 SB, 49, 23 R; 206/411, 813; 428/109, 110, 112–114

[56] References Cited

U.S. PATENT DOCUMENTS

| | | | |
|---|---|---|---|
| 698,266 | 4/1902 | Elliott | 229/52 B |
| 2,110,556 | 3/1938 | Scheinman et al. | 229/49 |
| 2,308,050 | 1/1943 | Burr | 229/49 |
| 2,710,135 | 6/1955 | Gaylord | 229/49 |
| 3,266,708 | 8/1966 | Ellis | 229/199 |
| 3,301,452 | 1/1967 | Jester | 229/52 B |
| 3,504,844 | 4/1970 | Stark et al. | 206/813 |
| 3,700,536 | 10/1972 | Bentvelzen et al. | 428/110 |
| 4,160,519 | 7/1979 | Gorham | 229/199 |
| 4,550,048 | 10/1985 | Nakagawa | 229/52 B |

FOREIGN PATENT DOCUMENTS

| | | | |
|---|---|---|---|
| 597956 | 5/1960 | Canada | 229/52 B |
| 2739544 | 3/1979 | Fed. Rep. of Germany | 229/52 B |
| 1421580 | 11/1965 | France | 229/52 B |
| 675283 | 7/1952 | United Kingdom | 229/52 B |

*Primary Examiner*—Stephen Marcus
*Assistant Examiner*—Gary E. Elkins

[57] ABSTRACT

The blank produces a box having on at least one of its sides, near its upper portion, a hand grasping aperture substantially vertically centered with respect to the side. Between the aperture of at least one side and the top edge of this side, on the innermost ply of the fibreboard, a load diffusing reinforcing band extends along the sides, thereby defining an endless circumferential band enabling diffusion of the load and tear prevention of the box, and particularly on portions having critical stress points. Between the aperture of at least one side and the top edge of this side, on one of the plies of the fibreboard, but away from the innermost ply and not adjacent thereto, vis-à-vis the load diffusing reinforcing band, a constraining reinforcing band extends along the sides thereby defining an endless circumferential band constraining the sides of the box and strengthening the fibreboard above the hand grasping aperture and its vicinity. This construction provides extended life over the conventional construction.

11 Claims, 4 Drawing Figures

BLANK AND A BOX THEREFROM HAVING EXTENDED LIFE

This invention relates to blanks for corrugated fibreboard boxes, to said boxes and particularly to such boxes for carrying objects having tapered top, said boxes having at their ends at least one opening for hand grasping.

BACKGROUND OF THE INVENTION

Boxes for beer and the like, made of corrugated fibreboards having several kraft paper plies, and provided with openings for hand grasping are well known to the trade. However, it has been found that when these boxes are hand manipulated several times, for example, through certain distribution systems, and particularly when they are pulled from one end and swung with, for instance, twenty-four beer bottles, the boxes start to deteriorate. In some areas, manufacturers, distributors, and sales outlets are encountering difficulties and have real concern as to the safety of the box and its protection from broken bottles, as well as appearance, attractiveness and functionality when selling them to the ultimate customer.

To overcome the deterioration of the hand manipulated boxes, and in particular the tearing of the load carrying area about the hand grasping apertures of the ends, suggestions have been made to provide boxes with a reinforcing member between the outer facing and corrugated medium, between the top edge of the ends and their apertures, as described in Canadian Pat. No. 650,568 of Oct. 16, 1962 as invented by Wallace and Hurrell. However, in practice it is found that the reinforcing member in these boxes tends to cut through the outer facing, without reinforcing member failure, causing tearing and ultimate deterioration of the box when hand manipulated several times. Even when the reinforcing member is located at different areas on or in the corrugated fibreboard, tearing of the area about the hand grasping aperture appears inevitable in beer boxes and the like.

In order to overcome this difficulty, one is left with choices such as increasing the strength of the entire box, which means substantial increase in production cost, and thereby in unit cost. Applicant has now found new means to overcome the above mentioned difficulties without increasing the strength or thickness of the entire box.

BRIEF DESCRIPTION OF THE INVENTION

Broadly stated, the invention is directed to a corrugated fibreboard box having sides, bottom flaps extending from said sides, means of fastening said bottom flaps to define a bottom, at least one of the sides, having near its upper portion a hand grasping aperture, said aperture being substantially vertically centered with respect to said side, between said hand grasping aperture on at least one of the sides and the top edge of said side, on the innermost ply of said fibreboard, a load diffusing reinforcing band, said band further extending along said sides, on their upper portion thereby defining an endless circumferential reinforcing band enabling diffusion of the load and tear prevention of the box, and particularly on portions having critical stress points, and between said hand grasping aperture on at least one of the sides and the top edge of said side, on one of the plies of said fibreboard, but away from said innermost ply, and not adjacent thereto, and vis-à-vis said load diffusing reinforcing band, a constraining reinforcing band, said reinforcing band extending along said sides on their upper portion defining an endless circumferential reinforcing band constraining said sides of said box and strengthening the fibreboard above said aperture and its vicinity.

The invention is also directed to a corrugated fibreboard blank defining a box having side panels, said side panels extending at their opposed top and bottom edges respectively into foldably connected top and bottom flaps to define the respective top and bottom of a box, at least one of said side panels having near its upper portion, a cut portion defining an aperture to enable hand grasping of said box, said aperture to be substantially vertically centered with respect to said side panel, between said aperture on at least one of said side panels and the top edge of said side panel, on the innermost ply of said fibreboard, a load diffusing reinforcing band, said band further extending along said side panels on their upper portion to define an endless circumferential band along said side panels thereby enabling diffusion of the load and tear prevention of the box resulting from said blank, and particularly on portions having critical stress points, between said aperture on at least one of said side panels and the top edge of said side panel, on one of the plies of said fibreboard, but away from said innermost ply and not adjacent thereto, vis-à-vis said load diffusing reinforcing band, a constraining reinforcing band, said band further extending along said side panels on their upper portion thereby defining an endless circumferential band constraining the sides of said box to result from said blank and strengthening the fibreboard above said aperture and its vicinity.

BRIEF DESCRIPTION OF THE DRAWINGS

Referring now to the drawings which illustrate the invention.

Referring now to FIG. 1, the blank has side panels foldably connected in a series such as defined by side panel 12, extending away on opposed edges into foldably connected opposed side panels 14, 16. Side panel 16 further extends away from side panel 12, into respectively foldably connected side panel 18 and manufacturer's joint or joint panel 20, the side panels to be bent defining the walls of a square or rectangular box secured by fastening manufacturer's joint 20 to the first side panel in the series, side panel 14, and preferably towards the inside of the box and thereby providing uniform outer walls of said box. Manufacturer's joint 20 may be fastened with glue or adhesive, stitches or other fastening means and if desired, manufacturer's joint 20 may otherwise be foldably connected to side panel 14, away from side panel 12 and thereby secured with side panel 18 to define the walls of the box. Other joint means may also be used, if desired, to unite the sides of the box.

Figure 1:
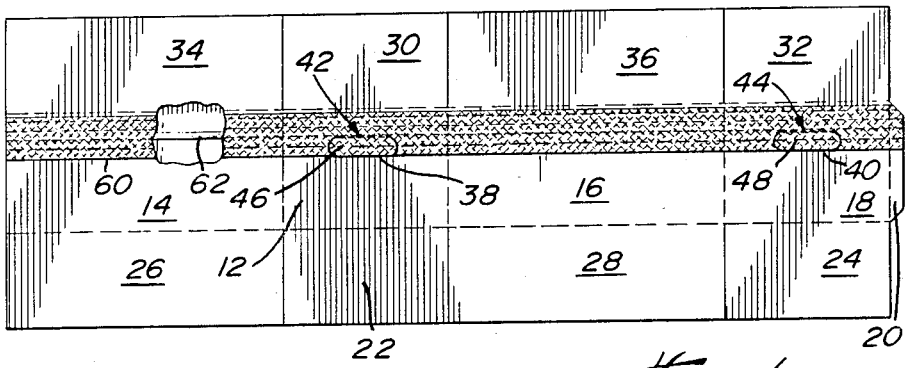
FIG. 1 is a plan view of a blank in accordance with one embodiment of the invention.

Opposed side panels 12, 18 and opposed side panels 14, 16 respectively extend at opposed edges into foldably connected bottom flap 22, 24 and 26, 28 and top flap 30, 32 and 34, 36. Bottom flaps 22, 24 are generally bent so as to face each other in the same plane, bottom flaps 26, 28 then bent to also face each other in the same plane and preferably having a gap between them, part of flaps 26, 28 overlapping and fastened to flaps 22, 24 with glue, adhesive, staples or other fastening means, thereby defining the bottom of the box and strengthening the box. The pairs of top flaps 30, 32 and 34, 36 may be similarly bent, overlapped and fastened, thereby defining the top of the box and preventing the side walls from any undesired inward or outward movements.

If desired, the top of the box may be of various constructions well known to the trade, as for instance, a top defined by top flaps 30, 32 only, each further upwardly extended into a panel with locking tabs at each side edge. The top flaps 30, 32 are bent to define the top surface of the box, the panels with locking tabs, facing each other and penetrating into the box and secured by the locking tabs engaging into cooperating apertures in side panels 14, 16.

At least one of the side panels, preferably two opposing side panels 12, 18 as shown, have near their upper portion, each a cut line, respectively 38, 40, preferably ending into fold lines 42, 44, to define flaps 46, 48: The uppermost portion of each flap 46, 48 is foldably connected to the upper portion of the side panels 12, 18. Said flap 46, 48 is substantially vertically centered with respect to side panel 12, 18, and is bent about the fold line 42, 44 to provide hand grasping aperture of said box. If desired, the flaps may be omitted, cut lines 38, 40 thereby defining hand grasping apertures centered between the side panels 14, 16.

The blank is, for instance, a fiberboard of the corrugated type having three ply, namely; innermost ply (inner facing), corrugated ply or medium and outermost ply (outer facing).

The innermost ply is fused to an adjacent surface of the corrugated ply, the latter further fused, away from the innermost ply and not adjacent thereto, to an adjacent surface of the outermost ply: The corrugated ply is between, and fused to an innermost ply and an outermost ply.

Throughout the disclosure and claims, the expression "to fuse" means to join two or more like or unlike elements together by any number of means preferably such as with heat, to release built-in adhesives or to activate added adhesives, with compression to cause adherence, or with the addition of a bonding agent or element, such as glue or film.

Load diffusing reinforcing band 60 is fused, preferably such as by being glued with adhesive or compressed or by other means if desired, on the innermost ply of the fibreboard, between the flap 46 and preferably substantially up to the top edge of side panel 12, reinforcing band 60 further extending along, onto side panels 14, 16, 18 and manufacturer's joint 20. Other means may be used if desired. The end section of band 60, located on manufacturer's joint 20, overlaps the other end section of band 60, located on part of side panel 14. The manufacturer's joint 20 is secured to side panel 14 thereby also securing the two end sections of band 60 adjacent one another, defining a never ending circumferential band. Reinforcing band 60 thereby defines on the upper portion of the side panels and manufacturer's joint 20, a circumferential endless band on or near the inside of the box, preferably said band 60 is a network of multi-directional elongated fibres preferably laminated with kraft paper. Each fibre is preferably a thermoplastic and/or glass fibre, and must be highly withstanding tension and tearing thereby being substantially unstretchable. Other fibres highly withstanding tension and tearing may be used if desired. The substantially unstretchable fibres must provide load diffusion by transfering the load away from the fibreboard to the fibres, the fibres transmitting the load to other fibres crossed, until the load usually carried by a small area of the box has been dispersed and diffused by the fibres covering a larger area of the box. Thus, the fibres preferably being in various directions, criss-crossing each other at various angles enable diffusion of the load multi-directionally away from the load carrying area above the hand grasping apertures, substantially eliminating critical stress points around said apertures where high stress causes failure and tearing of fibreboard and further substantially preventing the creation of tears and restraining the propagation of tears about the location of the band 60.

It is preferably that load diffusing reinforcing band 60 extends downwardly over at least part of the upper portion of flaps 46, 48, as shown, to reinforce the upper hand grasping surface provided by flaps 46, 48 when bent.

Constraining reinforcing band 62 is fused, preferably by being compressed, glued by adhesive or heated to release built-in adhesives or by other means if desired, to one of the plies of the fibreboard, but away and not adjacent to the innermost ply, and preferably between the corrugated and outermost plies, as shown. Reinforcing band 62 is located between the flap 46 and the top edge of side panel 12 and extends along, onto side panels 14, 16, 18 and manufacturer's joint 20 and is vis-à-vis but preferably does not project beyond the longitudinal edges of load diffusing reinforcing band 60. The end sections of band 62 are adjacently secured as described for band 60 so as to form an endless circumferential band, to constrain the walls of the box from any inward and particularly outward motion and to strengthen the fibreboard above the hand grasping apertures and their vicinities, for maintaining said box substantially undeformable.

Constraining reinforcing band 62 may consist of elongated thermoplastic and/or glass fibres such as polyester or nylon, longitudinally joined together as in fiberglass tape, or fused together by a bonding agent and fused preferably to the corrugated ply and the outermost ply. Other fibres may be used in desired but such fibres as a group, must substantially withstand longitudinal stretching, thereby constraining the sides of the box from inward and outward deformations, and withstand lateral and oblique tearing, thereby strengthening the fiberboard to which it is fused to particularly resist against tears occuring at the critical stress points near the side edges of the hand grasping aperture and near the corners of the box.

In a particular embodiment, load diffusing reinforcing band 60 is three inches wide and constraining reinforcing band 62 is seven sixteenths of an inch wide, the widths of the two bands thereby at a ratio of about 7:1. In another embodiment, the ratio of the widths of the two bands is about 4:1. If desired, the widths of the bands may be increased or decreased, as boxes of different sizes, for carrying heavier or lighter loads, will require varying widths of reinforcing bands.

If desired, constraining reinforcing band 62 may be fused onto only the free outermost surface of the outermost ply.

Figure 2:
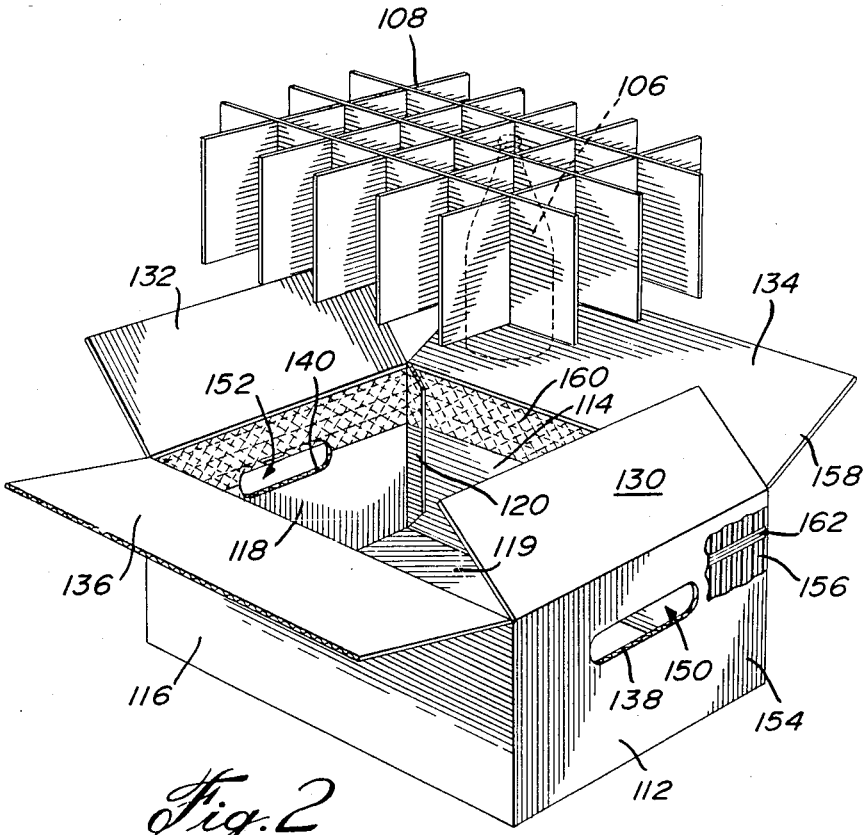
FIG. 2 is an isometric exploded view of a box, a twenty-four cell partition and a tapered object, in accordance with another embodiment of the invention.

Referring now to FIG. 2, the box, preferably for carrying objects with tapering upper portion, such as beer bottle 106 and including optional twenty-four cell partition 108, has opposed ends 112, 118 and opposed sides 114, 116 from which extend bottom flaps overlapped and fastened, as aforementioned, defining bottom 119 of the box. Said sides and ends preferably extend upwardly into respective foldably connected top flaps 130, 132 and 134, 136 which are bent, overlapped and secured, as discussed in FIG. 1, thereby enclosing the tapered objects and twenty-four cell partition within the box and cooperating with the reinforcing bands and the bottom to prevent deformation of the walls of the box.

Ends 112, 118 are preferably of a lesser width than sides 114, 116 thus providing a rectangular box. Near the upper portion of at least one end 112, 118, cut line 138, 140 defines hand grasping aperture 150, 152.

Circumferential load diffusing reinforcing band 160 is fused preferably to the free innermost surface of innermost ply 150, between the apertures 150, 152 and the top edge of ends 112, 118, along the sides and ends of the box, and extends to surround the uppermost edge and part of the side edges of apertures 150, 152 and thereby prevent tears at the critical stress points around the apertures. Said band 160 enables diffusion of the load away from the critical load carrying area about the hand grasping apertures 150, 152 and thereby prevents the creation and/or propagation of tears particular to the above mentioned load carrying area.

Constraining reinforcing band 162 is fused circumferentially along the sides and ends of the box, to the outermost ply 154 and preferably to the corrugated ply 156 between the top edge of the ends 12, 18 and their respective apertures 150, 152. Said band 162 is preferably of the type having substantially unstretchable fibres longitudinally oriented to increase the tensile properties of the band and thereby constrain the wall of the box and strengthen the fibreboard above the hand grasping apertures and their vicinities, for maintaining the box substantially underformable.

As shown, constraining reinforcing band 162 is preferably with its lower longitudinal edge abutting with the uppermost portion or edge of apertures 150, 152 to provide constraining of the walls and strengthening above the apertures and their vicinities at the critical stressful areas particularly caused by pulling or swinging the box from one end. The box, with its reinforcing bands, has an extended life, thereby allowing hand manipulation several times.

Figure 3:
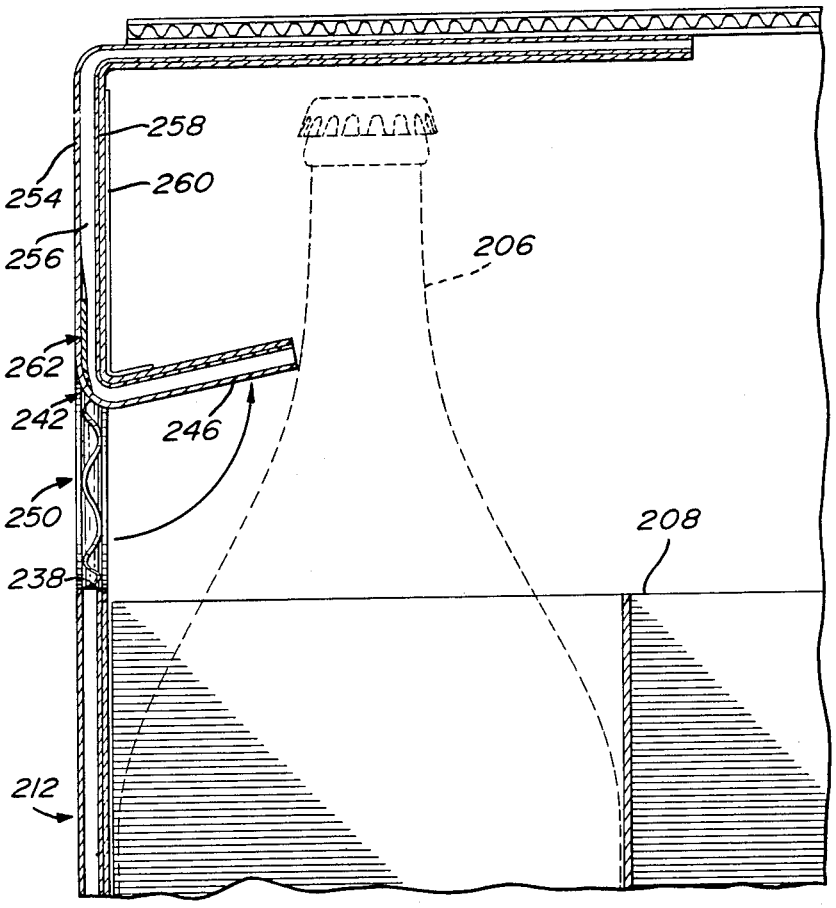
FIG. 3 is a partial longitudinal cross-sectional view of the box as shown in FIG. 2, showing an end and a tapered object within the box, in accordance with a preferred embodiment of the invention.

Referring now to FIG. 3, a partial cross-section of the box of FIG. 2, a preferred embodiment of the invention is shown. Tapered bottle 206 is behind, preferably shoulder height, partition 208 inside the box and adjacent to end 212. Cut line 238 ending into fold line 242 defines flap 246; the uppermost portion of flap 246 is foldably connected to the upper portion of the end 212. Flap 246 is preferably inwardly bent about fold line 242, defining hand grasping aperture 250 provided with a comfortable upper hand grasping surface, and easing the sliding of the fingers within said aperture. If desired, multiple parallel fold lines 242 may be used to ease the bending of flap 246. The lowermost edge of aperture 250 is preferably level with the shoulder of bottle 206, where the bottle begins to taper and reduce in circumference, to provide the largest and strongest load carrying area above or near the aperture 250 while still enabling comfortable hand grasping of the box.

Outer facing 254, corrugated medium 256 and inner facing 258 define the corrugated fibreboard.

Circumferential load diffusing reinforcing band 260, on the inner facing 258, extends to cover part of the upper portion of flap 246 to provide a strong and reinforced upper hand grasping surface.

Circumferential constraining reinforcing band 262, between the outer facing 254 and the corrugated medium 256, is preferably with its lower longitudinal edge in juxta-position with the uppermost portion of the flap 246 to prevent creation of tears above aperture 250.

Figure 4:
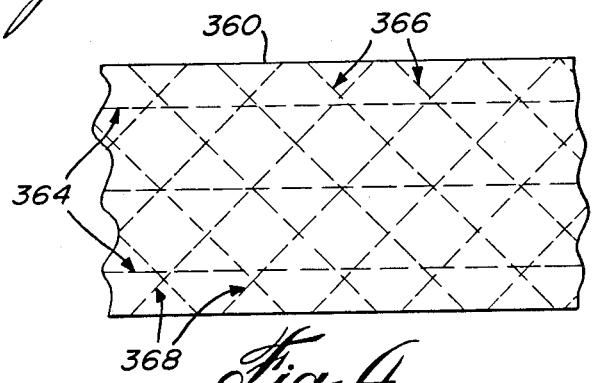
FIG. 4 is a plan view of the load diffusing reinforcing band, in accordance with another embodiment of the invention.

Now referring to FIG. 4, load diffusing reinforcing band 360, which is preferred embodiment of load diffusing reinforcing band 160 of FIG. 2, contains a network of substantially unstretchable fibres preferably laminated with at least one layer of kraft paper. Said network has a first group of substantially parallel and longitudinally oriented substantially unstretchable fibres such as 364, a second group of parallel fibres 366 substantially obliquely oriented, and a third group of parallel fibres 368 substantially perpendicular to fibres 366. The fibres of the second and third groups cross each other defining a diamond shaped network and cross the fibres of the first group, thereby providing multidirectional load diffusion, tension and tear resistance properties to the load diffusing reinforcing band 360 and thereby the panels reinforced with said band 360.

One advantage of the disclosed box over the conventional box is its extended life allowing extensive hand manipulation.

EXAMPLE

The following will serve to illustrate an embodiment of the invention. During a test period under same conditions, beer boxes, filled with twenty-four beer bottles, were pulled and swung with one hand off a horizontal surface above the floor, the arm and box allowed to swing back approximately 45° beyond vertical position and the box swung back to the original position on the horizontal surface. The conventional box experienced ripping and deterioration after 1.5 swings, whereas the disclosed box withstood upwards of 20 swings.

Modifications can be made without departing from the spirit of the invention as defined in the appended claims.

I claim:

1. A corrugated multi-ply fibreboard box, the innermost ply of said multi-ply fibreboard defining the inside surface of said box, said box having sides, each of said side having a top edge and opposite said top edge a bottom flap extending from each of said sides, means of fastening each of said bottom flap to define a bottom, at least one of the sides, having in its top half portion a hand grasping aperture, said aperture being substantially vertically centered with respect to said at least one of the sides, between said hand grasping aperture in said at least one of the sides and said top edge of said at least one of the sides, fused on said innermost ply, a load diffusing reinforcing band, said band further extending along each of said sides, as to form an endless circumferential reinforcing band on the top half portion of said box, said band having a network of substantially unstretchable fibres selected from the group consisting of synthetic and man-made fibres and thereby forming a supple and multi-directionally tension and tear resistant band enabling a load resulting from grasping said hand grasping aperture, to be diffused along said band and into said plies and avoiding critical stress points and resisting tears when said box is subjected to said load, and between said hand grasping aperture on said at least one of the sides and said top edge of said at least one of the sides, fused on one of said plies other than said innermost ply, and not adjacent to said innermost ply, and vis-à-vis said load diffusing reinforcing band, a constraining reinforcing band, said constraining reinforcing band further extending along each of said sides, as to form an endless circumferential reinforcing band on the top half portion of said box, said constraining reinforcing band having a plurality of parallelly oriented substantially unstretchable fibres selected from the group consisting of synthetic and man-made fibres selected from the group consisting of synthetic and man-made fibres, and thereby forming a supple longitudinally tension-resistant and transversally tear-resistant band to constrain said sides of said box, to strengthen the fibreboard above said aperture and its vicinity and to block any tears expanding towards said constraining reinforcing band.

2. The box as defined in claim 1 for carrying partly tapered bottles having a shoulder, wherein said hand grasping aperture is ovoid-like defined by a top horizontal cut and a bottom horizontal cut, connected at their respective end by U-shaped cuts wherein said bottom horizontal cut is substantially level with said shoulder of said partly tapered bottles to be carried within said box, to maximize the area and strength of the load carrying area above and about said aperture, and wherein said constraining reinforcing band, horizontally abuts said top horizontal cut of said hand grasping aperture thereby constraining and strengthening the fibreboard at said critical stress points above said aperture.

3. The box as defined in claim 2 wherein said load diffusing reinforcing band extends to surround said hand grasping aperture at least on said top horizontal cut and part of said U-shaped cuts, to prevent tearing at said critical stress points about said aperture.

4. The box as defined in claim 1 wherein said hand grapsing aperture is defined by said at least one of the sides having a horizontal cut extending upwardly at each end into a U-shaped cut to form a flap, the end of said each of U-shaped cut joined to form a foldably hingeable portion, said foldably hingable portion enabling said flap to form a foldable hinged flap to be bent inwardly into said box and thereby define said hand grasping aperture, and wherein said load diffusing reinforcing band extends and is fused over at least said foldably hinged portion of said flap, thereby providing a comfortable and reinforced upper hand grasping surface having tear-resistance.

5. The box as defined in claim 1 wherein said constraining reinforcing band is vis-à-vis but does not project beyond said load diffusing reinforcing band and wherein the ratio of the width of said load diffusing reinforcing band to the width of said constraining reinforcing band is in the range of 4:1 to 7:1.

6. The box as defined in claim 1 wherein said network consists in a first group of substantially parallel fibres longitudinally oriented, a second group of parallel fibres substantially obliquely oriented, a third group of parallel fibres substantially perpendicular to said fibres of said second group, said fibres of said second and third groups crossing each other to define diamond shaped network and crossing the fibres of said first group.

7. The box as defined in claim 6 wherein said network of fibres is laminated with at least one kraft paper.

8. The box as defined in claim 1 wherein said parallelly oriented fibres of said constraining reinforcing band, are fused together to substantially withstand longitudinal tension, lateral and oblique tearing.

9. The box as defined in claim 1 wherein said load diffusing reinforcing band is fused to the free surface of said innermost ply.

10. The box as defined in claim 1 wherein said fibreboard defining said sides consists of said innermost ply, an outermost ply, having fused therebetween a corrugated ply, and wherein said circumferential constraining reinforcing band is fused between said outermost ply and said corrugated ply.

11. A corrugated multi-ply fibreboard blank defining a box having side panels foldably connected in a series, each of said side panels having opposed top and bottom edges, each of said side panels extending at said opposed top and bottom edges respectively into foldably connected top and bottom flaps to define respectively a top and bottom for said box, each of said side panels having a top half portion defined as the portion from said top edge to midway between said top and bottom edges, said top half portion of all said side panels thereby defining the top half portion of said box, at least one of said side panels having in its top half portion, a cut portion to define an aperture to enable hand grasping of said box, said aperture being substantially vertically centered with respect to said at least one of said side panels, between said aperture on said at least one of said side panels and said top edge of said at least one of said side panels, fused on one of the plies of said fibreboard, said one of the plies to be the innermost ply of said box, a load diffusing reinforcing band, said band further extending along each of said side panels as to form an endless circumferential band on said top half portion of said box, said band having a network of fibres selected from the group consisting of synthetic and man-made fibres and thereby forming a supple and multi-directionally tension and tear resistant band enabling a load resulting from grasping of said box by said aperture, to be diffused along said band and into said plies and avoiding critical stress points and resisting tears when said box is subjected to said load, and between said aperture on said at least one of said side panels and said top edge of said at least one of said side panels, fused on a ply of said fibreboard other than said innermost ply, and not adjacent to said innermost ply and vis-a-vis said load diffusing reinforcing band, a constraining reinforcing band, said constraining reinforcing band further extending along each of said side panels as to form an endless circumferential band on said top half portion of said box, said constraining reinforcing band having a plurality of parallelly oriented fibres selected from the group consisting of synthetic and man-made fibres, and thereby forming a supple and transversally tear-resistant band to constrain the sides of said box to result from said blank, to strengthen the fibreboard above said aperture and its vicinity and to block any tears expanding towards said constraining reinforcing band.

* * * * *